US008777375B2

(12) United States Patent
Lewartowski et al.

(10) Patent No.: US 8,777,375 B2
(45) Date of Patent: Jul. 15, 2014

(54) PRINTING SYSTEM

(71) Applicants: Arnon Lewartowski, Ramat Gan (IL); Yaakov Levi, Kefar Yona (IL); Rom Condrea, Even Yehuda (IL)

(72) Inventors: Arnon Lewartowski, Ramat Gan (IL); Yaakov Levi, Kefar Yona (IL); Rom Condrea, Even Yehuda (IL)

(73) Assignee: Dip-Tech Ltd, Kefar Sava (IL)

( * ) Notice: Subject to any disclaimer, the term of this patent is extended or adjusted under 35 U.S.C. 154(b) by 0 days.

(21) Appl. No.: 14/162,307

(22) Filed: Jan. 23, 2014

(65) Prior Publication Data

US 2014/0132673 A1 May 15, 2014

Related U.S. Application Data

(63) Continuation of application No. 13/773,074, filed on Feb. 21, 2013, now Pat. No. 8,668,307.

(60) Provisional application No. 61/601,209, filed on Feb. 21, 2012.

(51) Int. Cl.
*B41J 25/00* (2006.01)

(52) U.S. Cl.
USPC ..... 347/37; 347/20; 347/44

(58) Field of Classification Search
CPC ..... B41J 19/16; B41J 25/003
USPC ..... 347/9–12, 15, 20, 37, 38, 40, 41, 43, 347/49–50
See application file for complete search history.

(56) References Cited

U.S. PATENT DOCUMENTS 6,273,550 B1 * 8/2001 Brown ..... 347/43
7,052,125 B2 * 5/2006 Askren et al. ..... 347/103

* cited by examiner

*Primary Examiner* — Thinh Nguyen
(74) *Attorney, Agent, or Firm* — Smith Risley Temple Santos LLC; Gregory Scott Smith

(57) ABSTRACT

A printing system including a substrate support and an ink deposition unit. The ink distribution unit deposits liquid ink onto a substrate positioned on the substrate support. The system allows for relative movement between the substrate support and the ink deposition unit. After printing, the ink deposition unit rotates to be oriented with the longitudinal axis of the next image segment to be printed and wherein the rotation does not affect the image resolution. The system can print at least two axial images sharing at least one common image portion and having an angle between their longitudinal axes less than 90 degrees.

13 Claims, 18 Drawing Sheets

PRINTING SYSTEM

CROSS-REFERENCE TO RELATED APPLICATIONS

This is a utility patent application being filed in the United States as a non-provisional application for patent under Title 35 U.S.C. §100 et seq. and 37 C.F.R. §1.53(b) and is a continuation of the U.S. patent application that was filed on Feb. 21, 2013 and assigned Ser. No. 13/773,074, which application claims the benefit of the prior filing date under Title 35, U.S.C. §119(e) of the U.S. provisional application for patent that was filed on Feb. 21, 2012 and assigned Ser. No. 61/601,209 and as such, the priority date of the present application is also Feb. 21, 2012. The above-referenced applications are incorporated herein by reference in their entirety.

TECHNICAL FIELD

The present apparatus and method relate to printing systems and more specifically to methods of printing employing large format printing systems.

BACKGROUND

Image forming systems include ink deposition units to form images on substrate. The ink deposition units could be such as inkjet printheads that eject droplets of ink and deposit the droplets on the substrate. Substrates could include different materials such as paper, plastics, glass, stone, and others. The printing is done in raster mode. Raster mode means that the images are printed or reproduced by scanning each and every line of a grid and depositing an ink droplet at a desired coordinate on the line/grid. At the end of the line, the printhead is moved back to the beginning of the scan and incrementally shifted to print another line. Printing in the raster printing mode is performed by accessing each of the points of the grid regardless if there is an ink droplet to be deposited at this point or not. Relative movement between the substrate and the printhead facilitates placing the ejected ink droplet on any point of the grid.

Some of the images to be printed could cover all surface of the substrate. Layout of other images could cover a segment of the substrate and continue on another segment of the substrate. There could be no printed image between the different image segments. Some images, for example, entrance doors or windshield windows of a car are printed on the borders of a substrate only. The desired image quality determines the print resolution and the grid pitch. High quality images are printed at high printing resolution and take much more time than images of similar size printed at a lower printing resolution. Generally, the printing time depends on the printing resolution, the size of the image and the geometry of the image. In large format industrial printing systems where the printing is performed on substrates with sizes of 3000×4000 mm or 5000×6000 mm the printing could take hours regardless of the image layout.

Printing time is reduced by assembling individual inkjet printhead modules into ink deposition units printing a larger then a single printhead module swath. Each of the individual inkjet printhead modules has a characteristic signature, since ink-ejecting orifices located along the module eject different sizes of ink droplets producing visible artifacts in the printed image. In some printing applications this effect is mitigated by what is termed multipass printing. In multipass printing the ink deposition unit moves back and forth and passes a number of times over the printed swath and different ink ejecting orifices deposit ink droplets contributing to the same segment of the image. In other more critical printing applications individual inkjet printhead modules could be rotated to mitigate swath butting artifacts, but the printing itself is performed in the same raster printing mode and no printing time is saved.

BRIEF SUMMARY

Existing digital printing systems operating in raster printing mode are optimized to print images covering the full substrate surface. The same printing systems are used to print images that cover a substantially smaller surface area of the substrate and in particular such images as for example, images on automotive glass windshield screens, decorative doors and windows, and similar objects. Although these images cover a substantially smaller surface area of the substrate the printing times could be the same.

A printing system including an ink deposition unit that could be oriented and move along a long axis of an image segment to be printed and could print images occupying a number of segments of a substrate surface at a substantially shorter time. The printing method could include printing consecutive segments of the final printed image. For example, the ink deposition unit could be activated to move along a first axial image segment, deposit ink along the first axial image segment, and print the first axial image segment. Upon completion of the first axial image segment printing, the ink deposition unit could be oriented and move along a second axial image segment. The ink deposition unit would be activated to deposit ink along the second axial image segment and print the second axial image segment. The printing of the first and second axial image segments is performed in a single continuous pass of the ink deposition unit.

The orientation of the ink deposition unit along a long axis of an axial image segment is such that a leading edge of the ink deposition unit remains the leading edge with respect to ink deposition unit movement direction throughout the printing process. Since the leading edge of the ink deposition maintains its orientation with respect to the ink deposition unit movement direction throughout the printing process, it maintains color printing order and mitigates color shift.

The first axial image segment and the second axial image segment could be at an angle to each other and could share at least one common image portion and could be segments sharing no common image portions. When the first image segment and the second segment share a common image portion the image data of these segments could be scrambled to reduce appearance of image artifacts.

The printing could be performed in a multipass printing mode and all of the multipass printing mode passes combined with the ink deposition unit orientation are in same direction of printing.

LIST OF DRAWINGS

The method and the apparatus are particularly pointed out and distinctly claimed in the concluding portion of the specification. The method and the apparatus, however, both as to organization and method of operation, may best be understood by reference to the following detailed description when read in conjunction with the accompanying drawings, in which like reference characters refer to the same parts throughout the different views. The drawings are not necessarily to scale, emphasis instead being placed upon illustrating the principles of the method and apparatus. In the drawings:

Figure 4A:
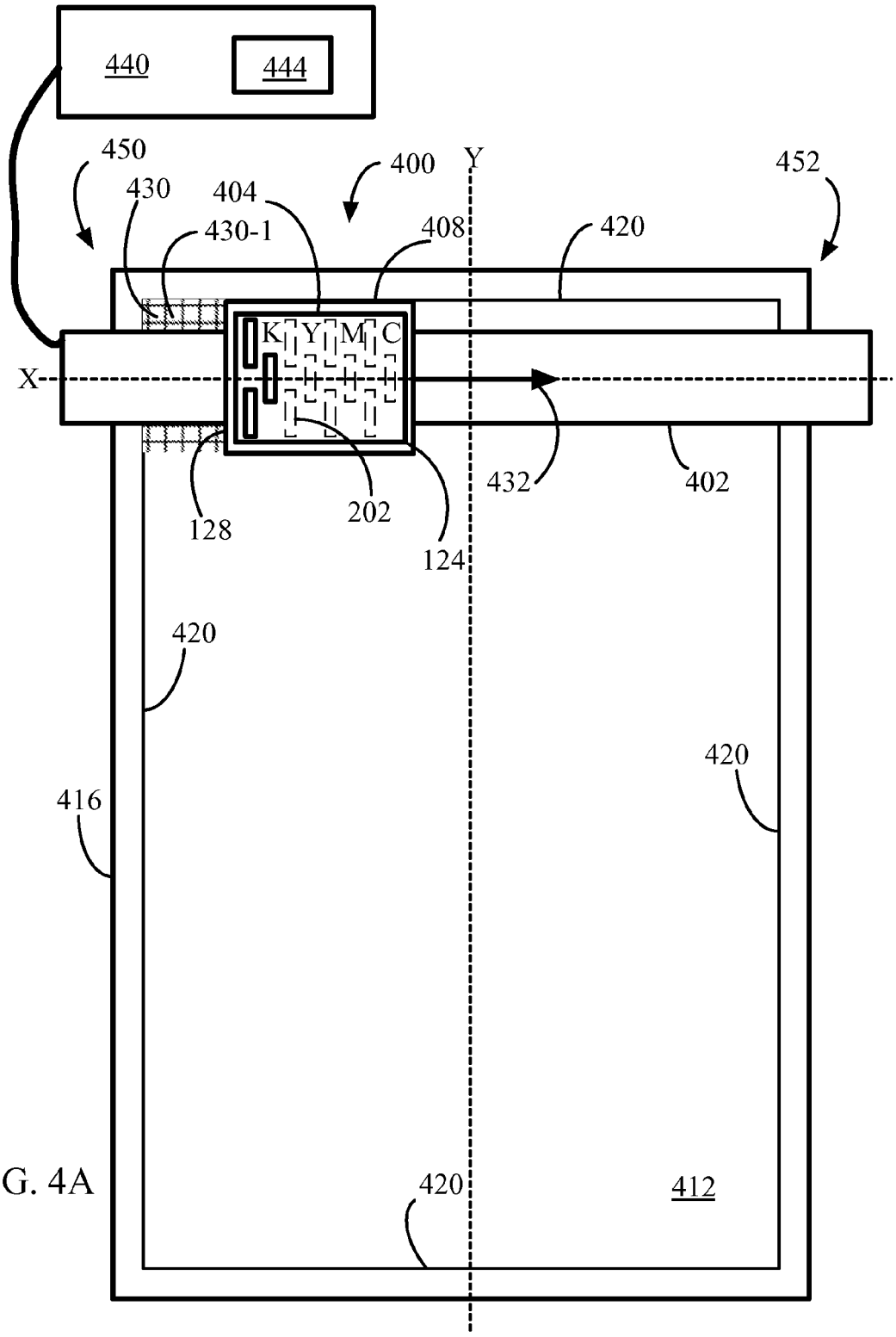
FIGS. 4A-4F illustrate a method of printing of a frame-like image employing a printing system according to an example.
Figure 4B:
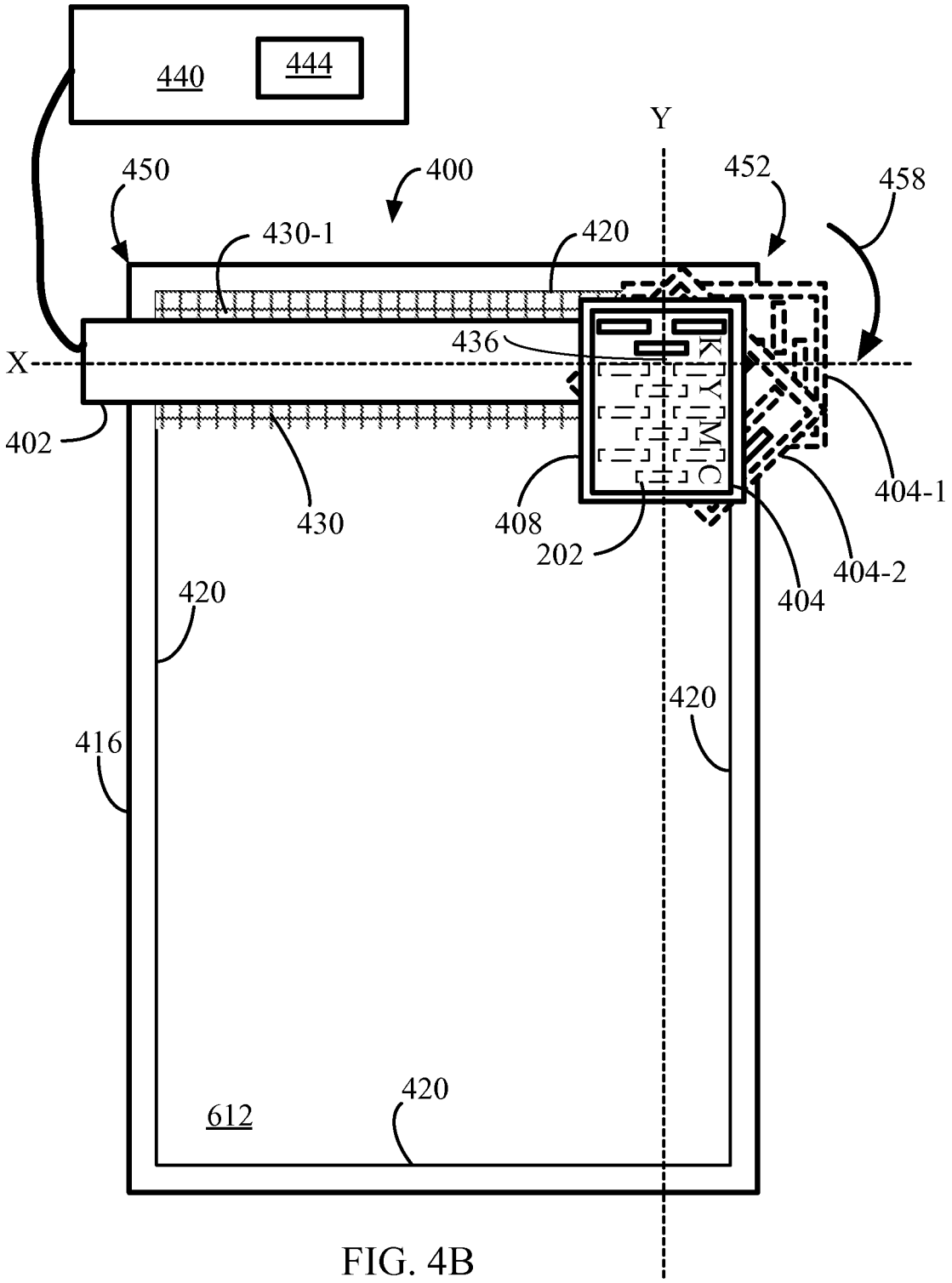
Figure 4C:
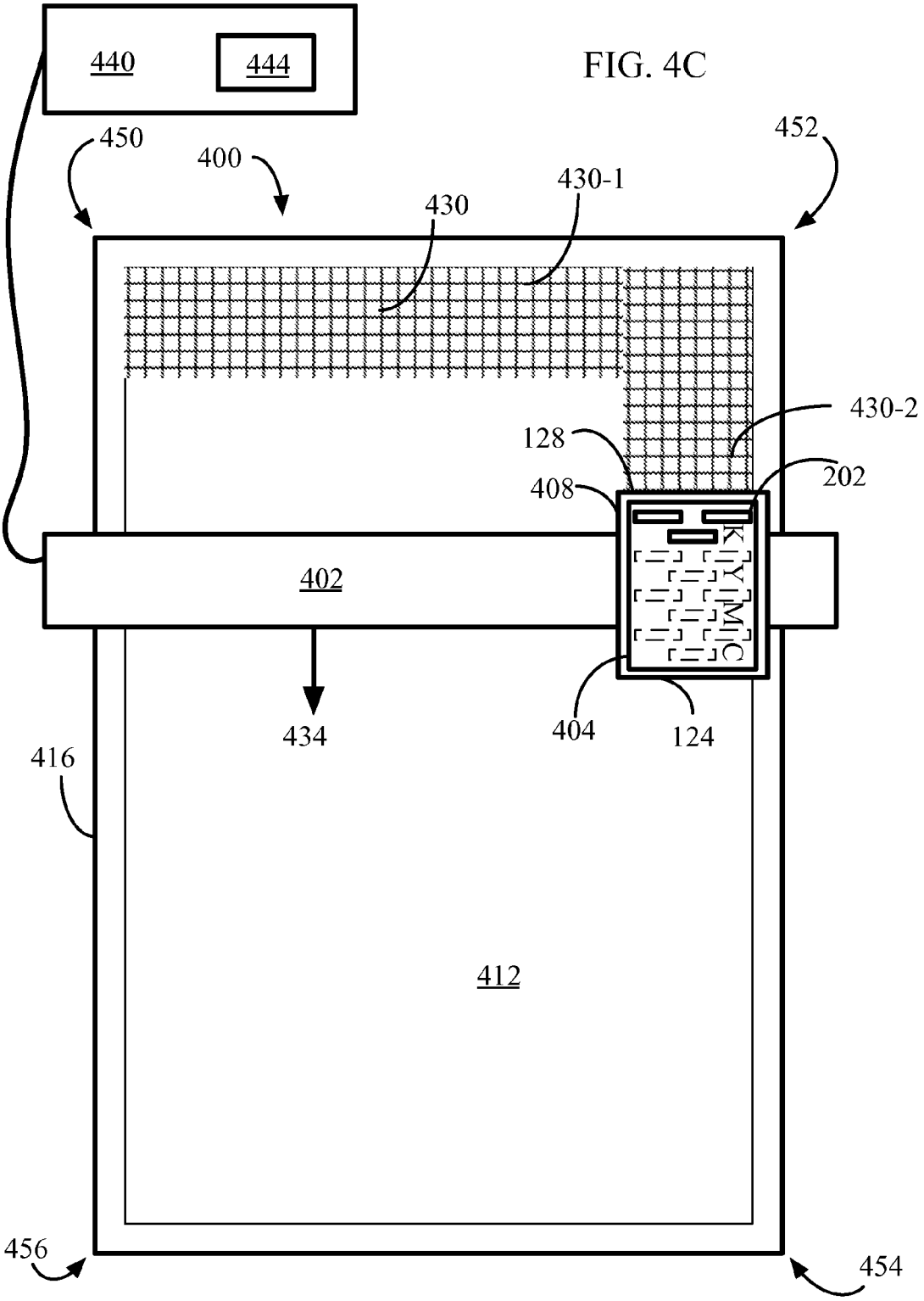
Figure 4D:
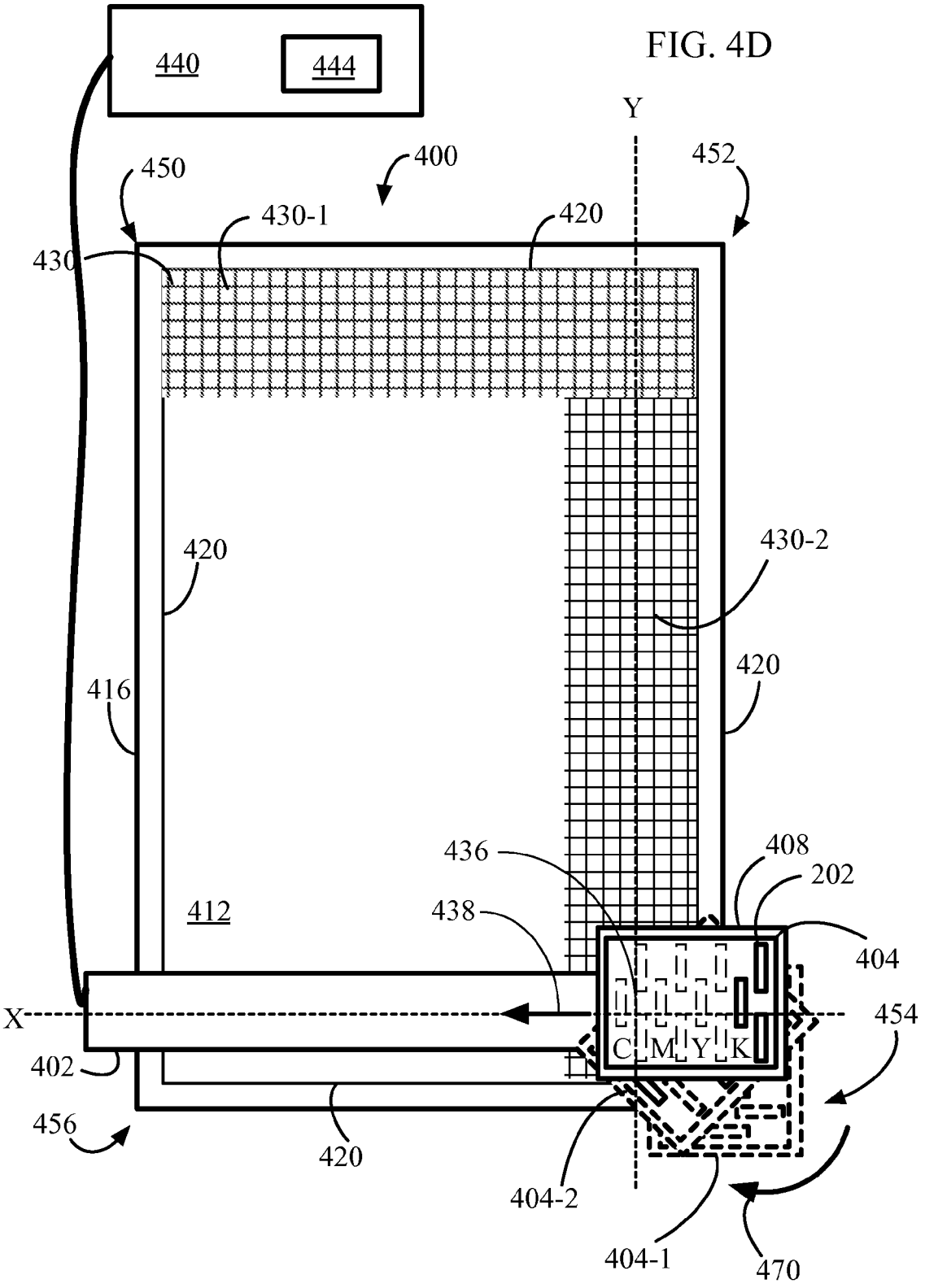
Figure 4E:
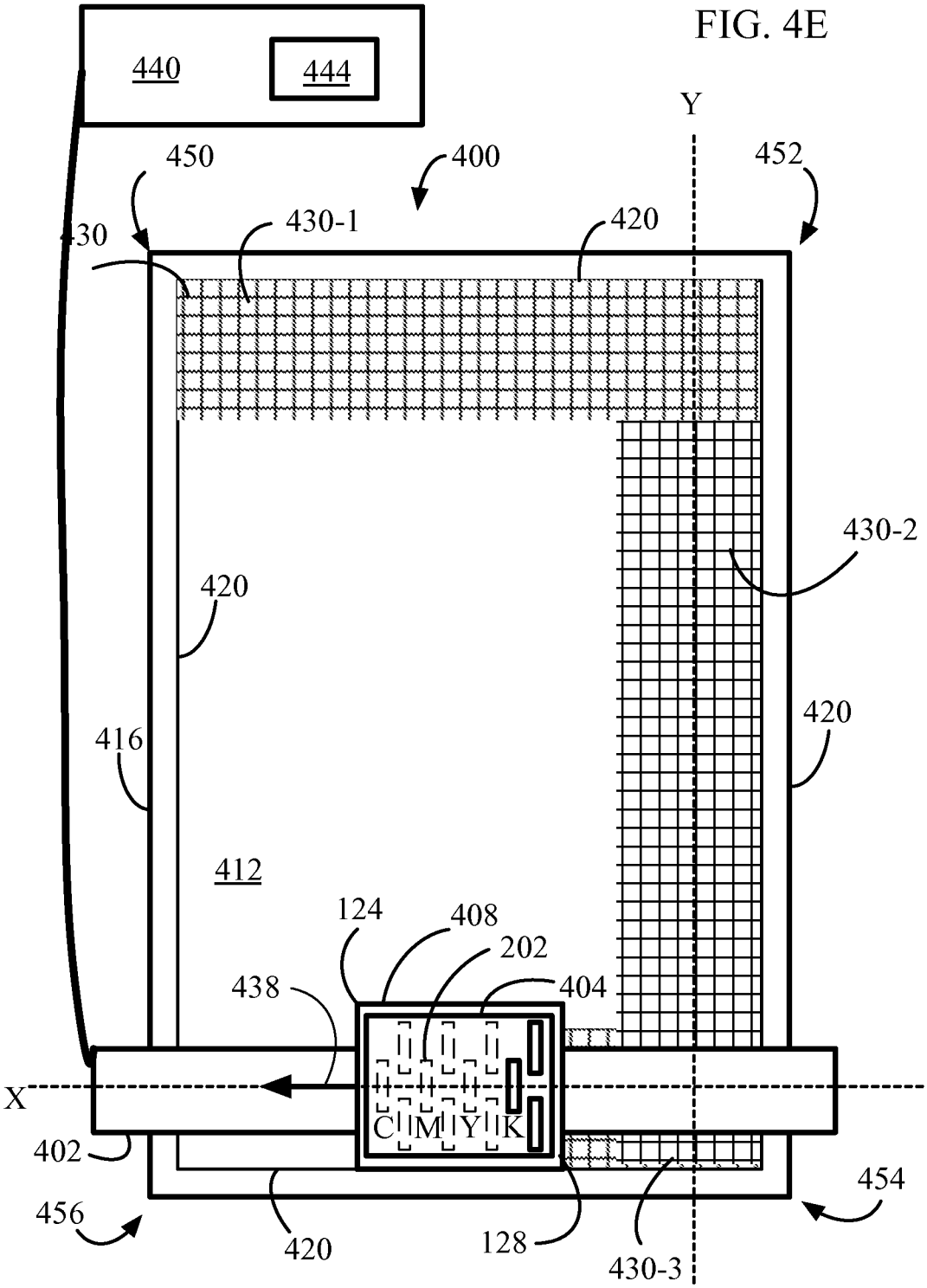
Figure 4F:
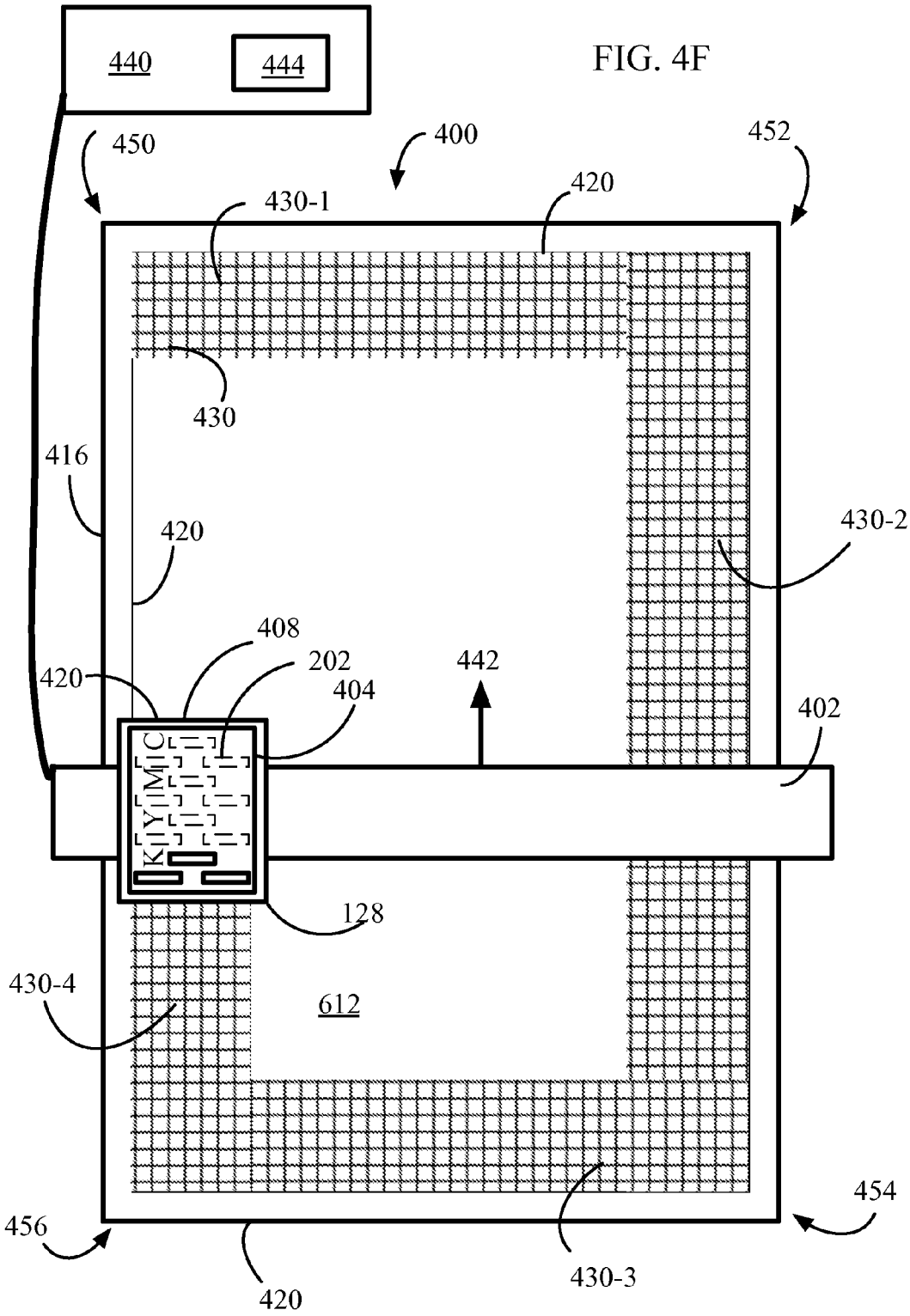
Figure 5:
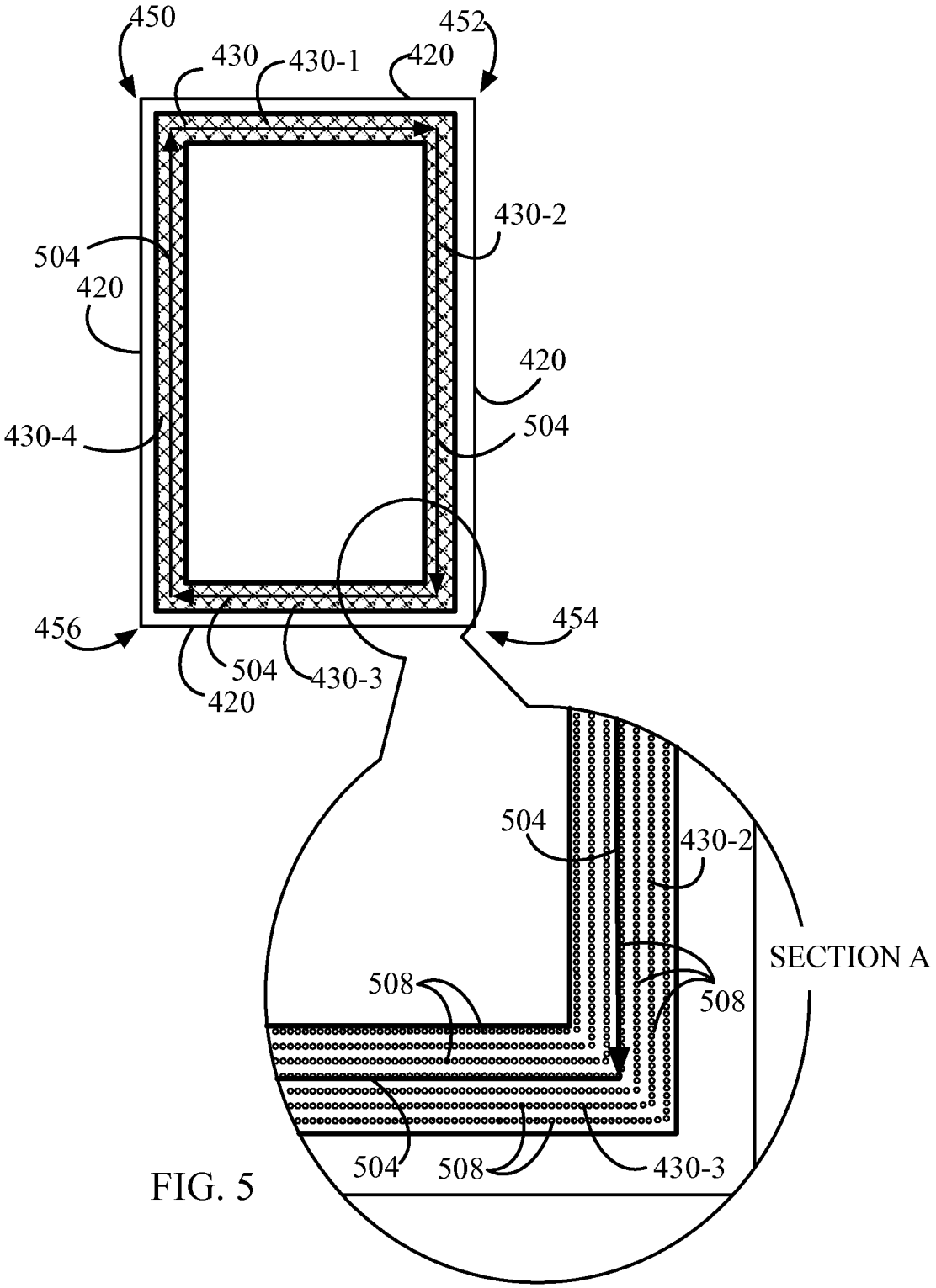
FIG. 5 is a plan view simplified illustration outlining the travel path taken by ink deposition unit printing a frame-like image according to an example.
Figure 6A:
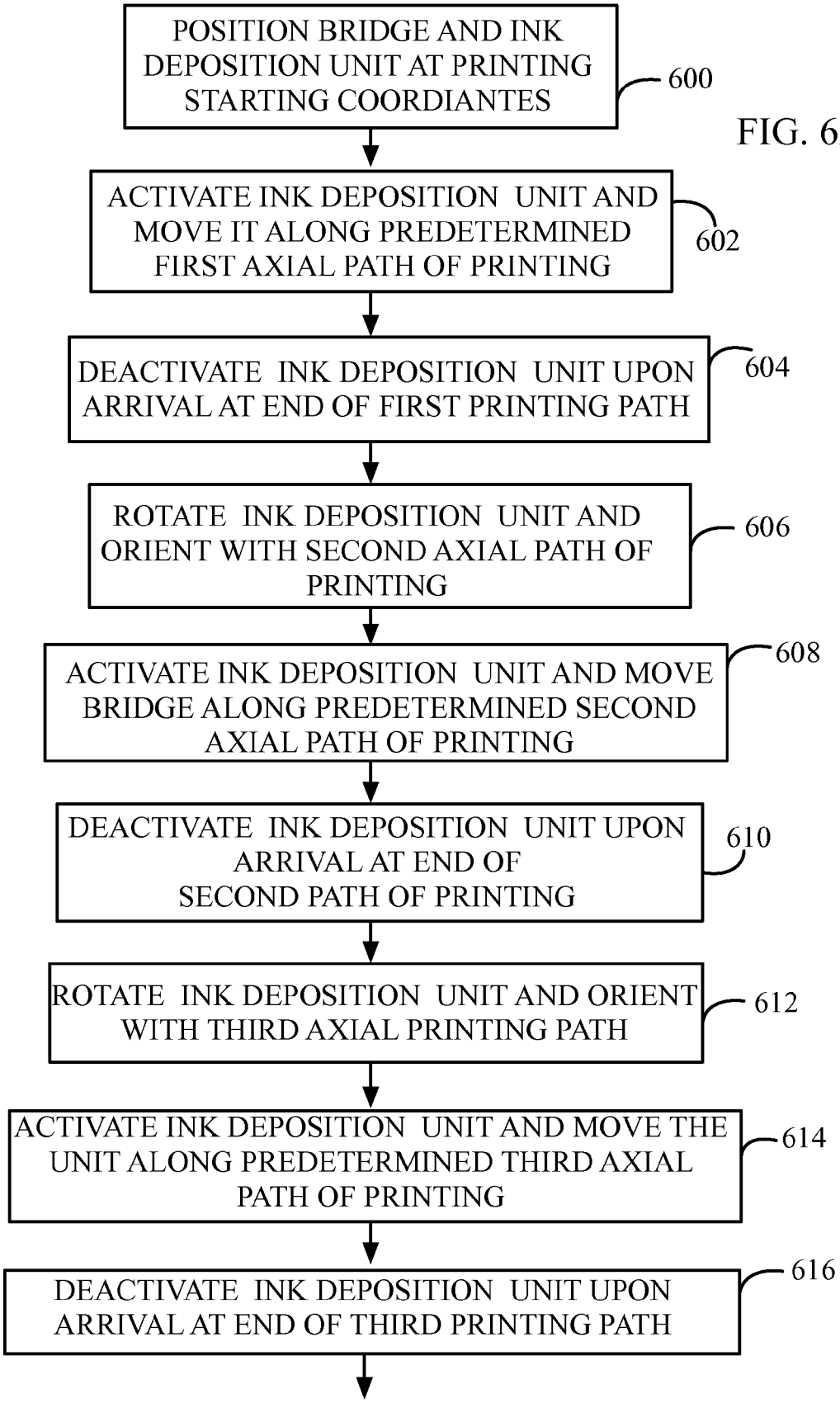
Figure 6B:
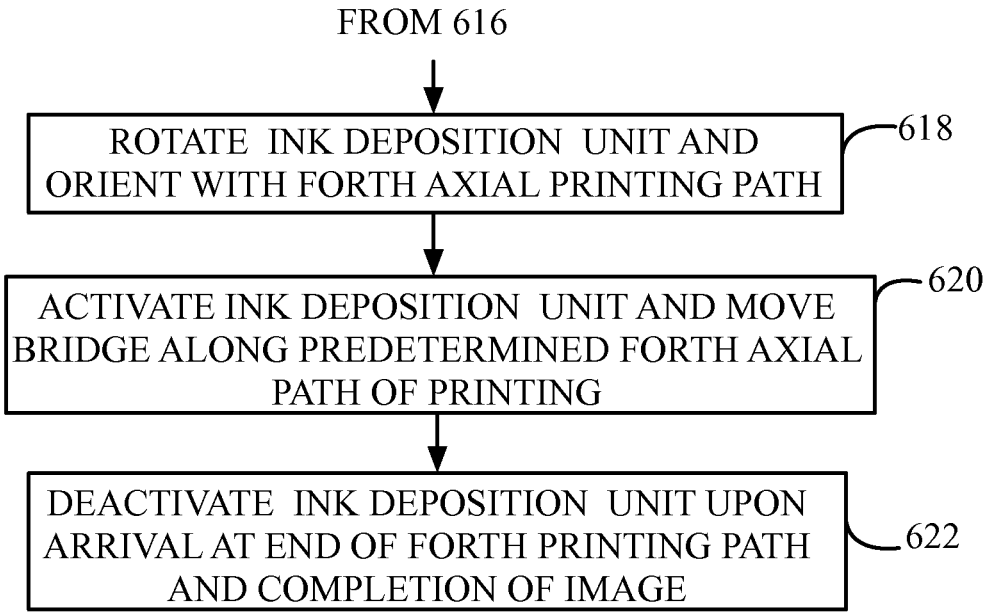
Figure 7A:
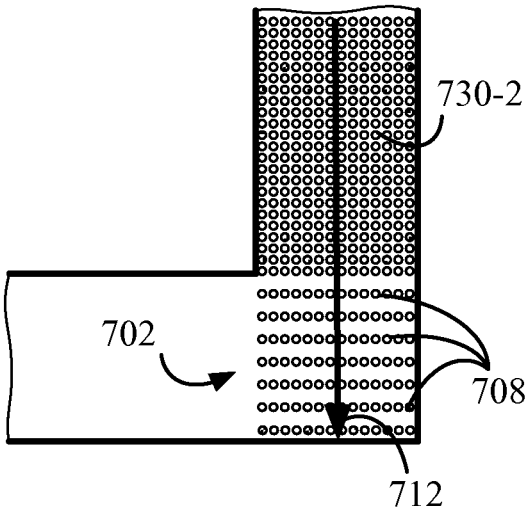
Figure 7B:
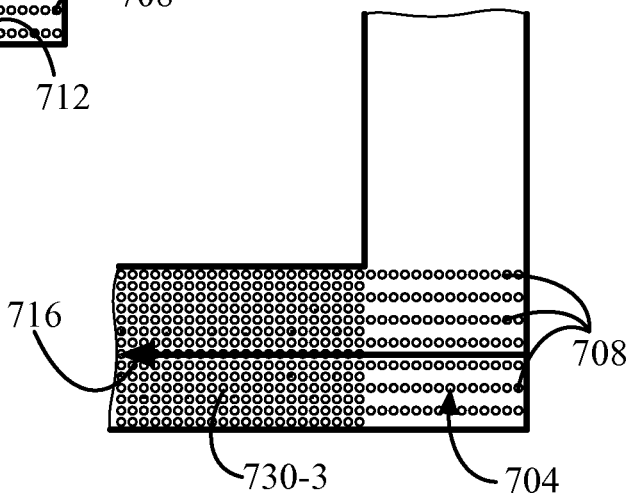
Figure 7C:
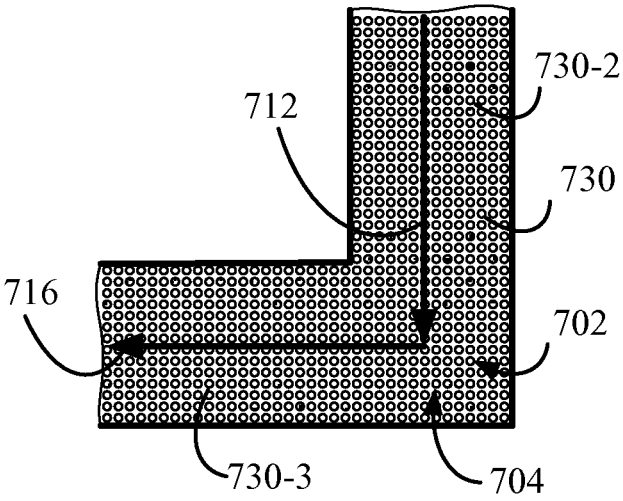
Figure 8A:
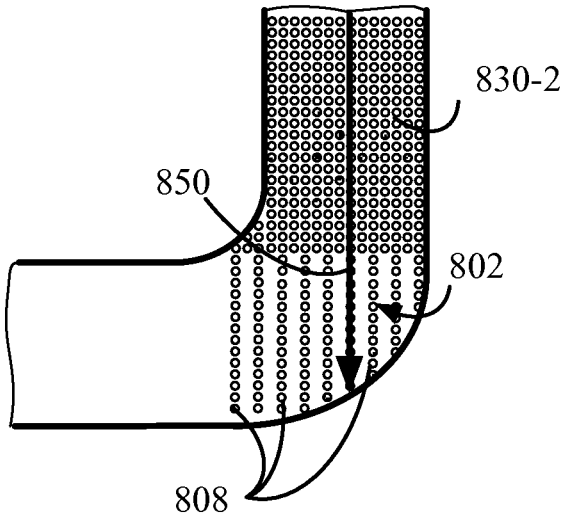
Figure 8B:
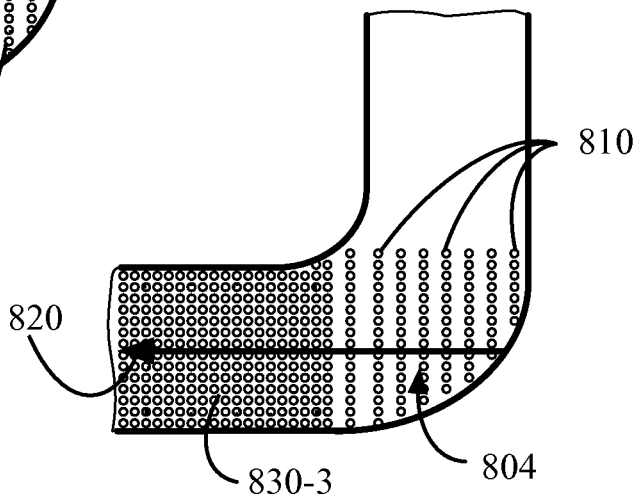
Figure 8C:
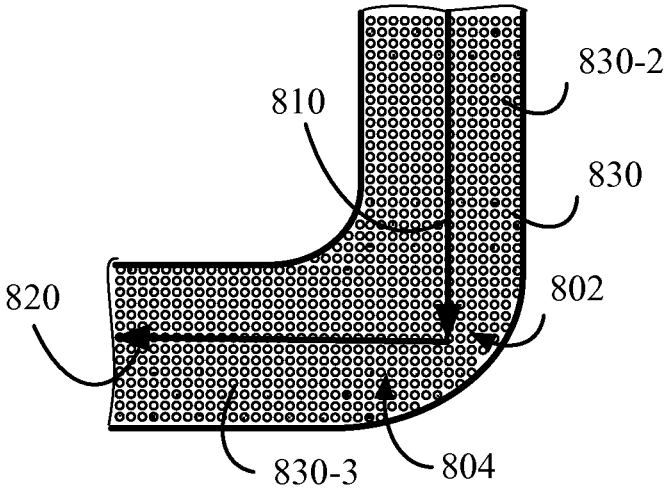
Figure 9A:
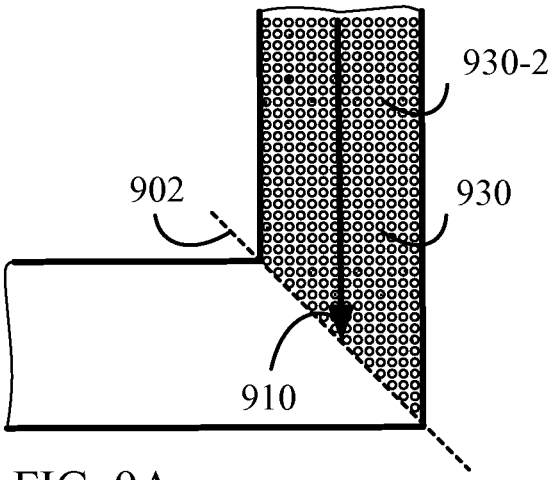
Figure 9B:
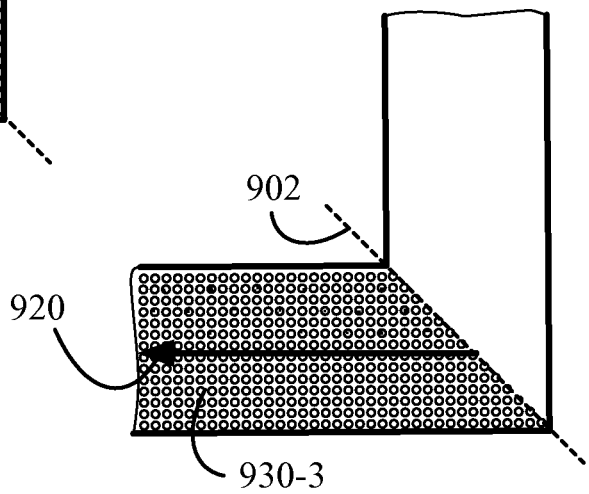
Figure 9C:
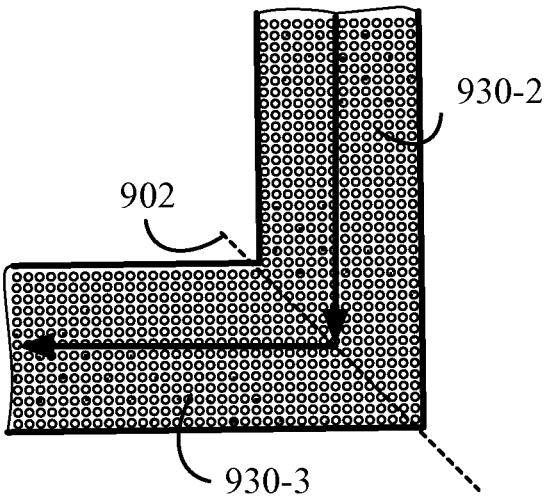
Figure 10A:
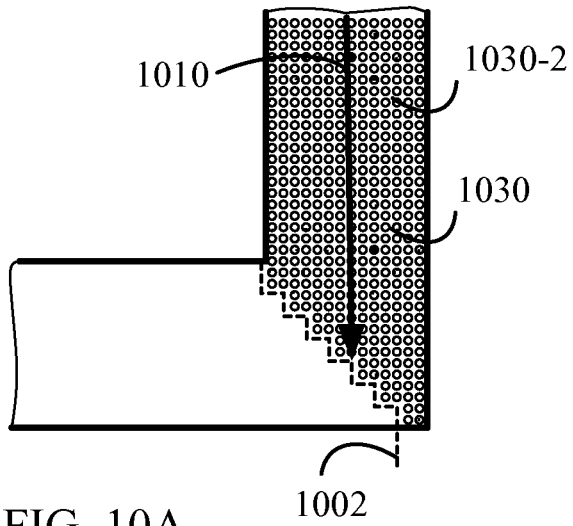
Figure 10B:
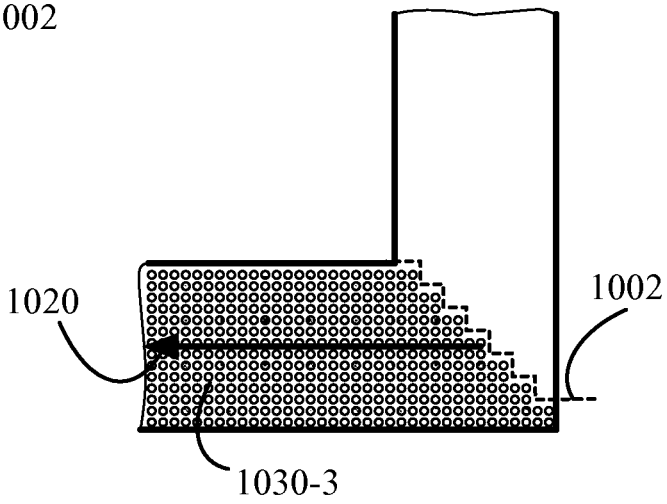
Figure 10C:
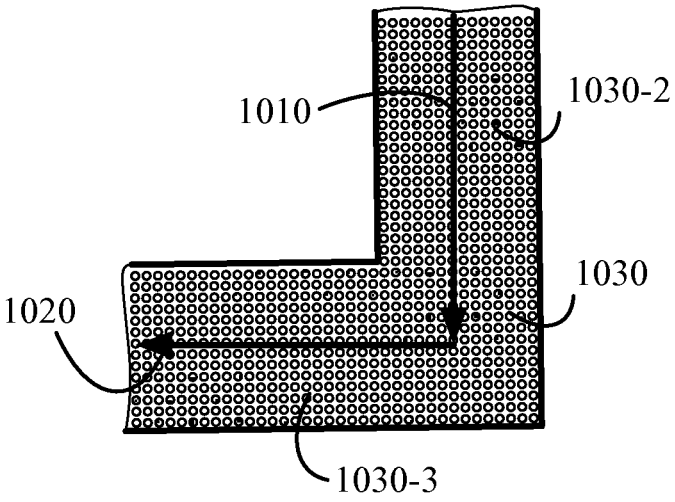

FIGS. 6A and 6B together form a flow diagram summarizing the example methods of FIGS. 4A-4F and 5;

FIGS. 7A, 7B and 7C are plan view simplified illustrations of a stitching method of two printed image segments according to an example;

FIGS. 8A, 8B and 8C are plan view simplified illustrations of a stitching method of two printed image segments according to an example;

FIGS. 9A, 9B and 9C are plan view simplified illustrations of yet another example of a stitching method of two printed segments; and FIGS. 10A, 10B and 10C are plan view simplified illustrations of a stitching method of two printed segments according to an example

DESCRIPTION

Figure 1:
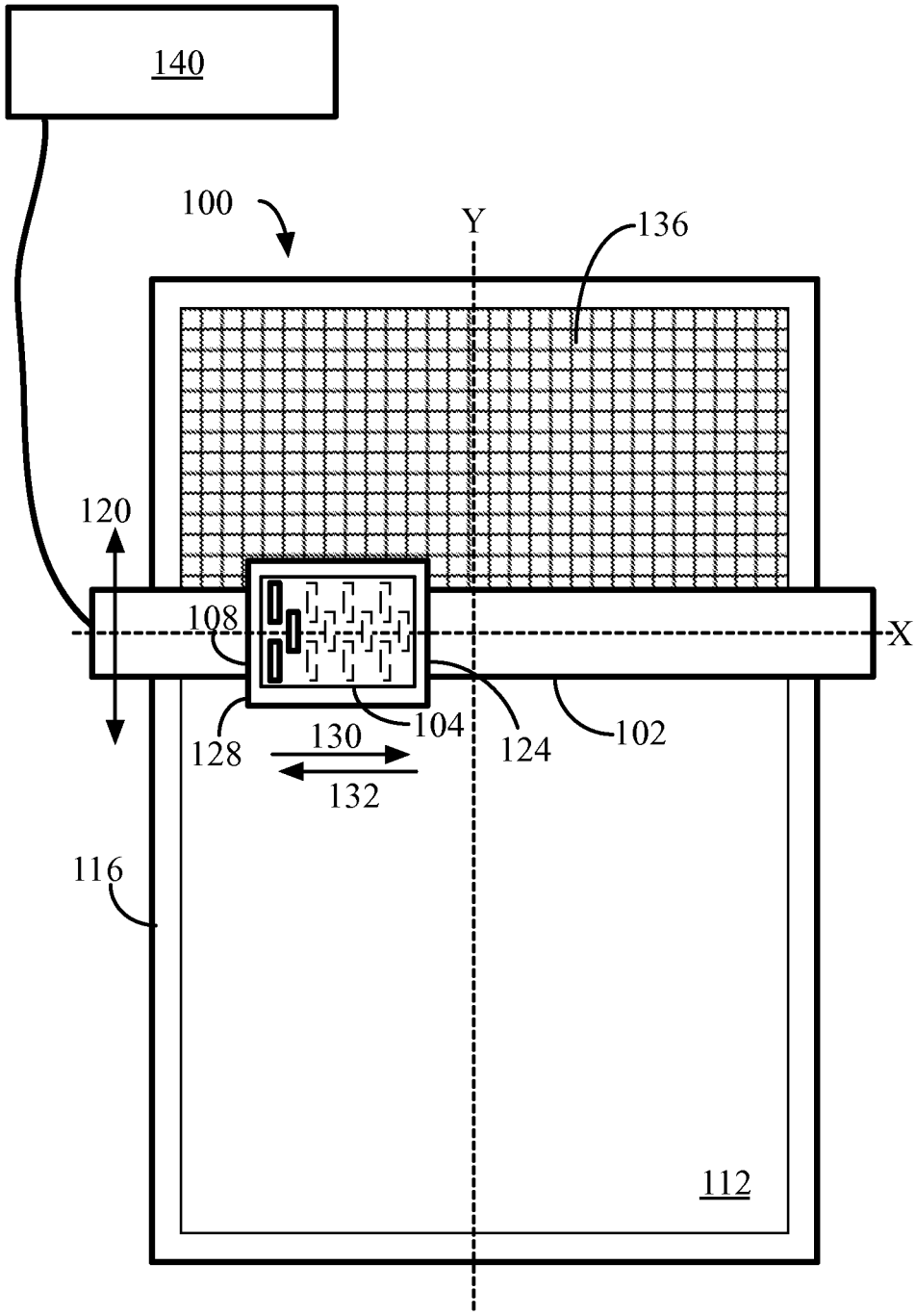
FIG. 1 is a plan view simplified illustration of an inkjet printing system according to an example.

Reference is now made to FIG. 1, which is a plan view simplified illustration of an inkjet printing system according to an example. The printing system could be a large format printing system or any other applicable printing system. A printing system 100 comprises a moveable bridge 102 capable of moving along a printing axis (Y) in directions indicated by an arrow designated reference numeral 120 and an ink deposition unit 104 mounted on a reciprocating carriage 108.

Ink deposition unit 104 could be an assembly of one or plurality of individual printhead modules 202 (FIGS. 2A and 2B) such as for example Spectra Nova PH 256 available from Spectra-Dimatix, Hew Hampshire USA or similar. Ink deposition unit 104 is configured to eject ink drops from the printhead modules 202 onto a substrate 112 when loaded onto a substrate support 116. In one example, substrate support 116 is configured to remain stationary whilst ink deposition unit 104 moves on a carriage 108, which reciprocates along bridge 102 (along a printing axis (X)) in directions indicated by arrows designated reference numerals 130 and 132. Reciprocating movement of carriage 108 in directions indicated by arrows designated reference numerals 130 and 132 is generally perpendicular to printing axis (Y). Numerals 124 and 128 mark edges of the ink deposition unit 104. A radiation source configured to cure the ink or a heat source configured to dry the ink could be associated with the bridge 102 or carriage 104 and move with it.

A computer 140, such as a PC, could control printing system 100. Printing system 100 functions to incrementally advance bridge 102 and ink deposition unit 104 to form a printed image 136 on a substrate 112 loaded onto substrate support 116 in a generally known raster mode. In some examples substrate support 116 could provide at least one of the movements generally, in direction of arrow 120.

Figure 2A:
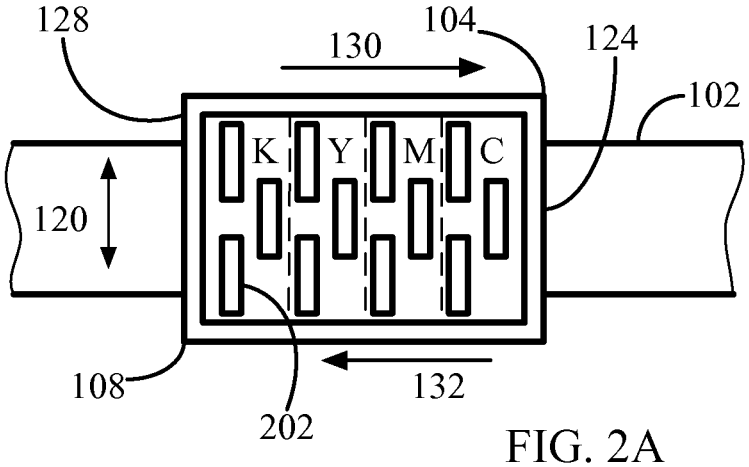
FIGS. 2A and 2B are plan view simplified illustrations of examples of ink deposition unit individual printhead modules orientation.
Figure 2B:
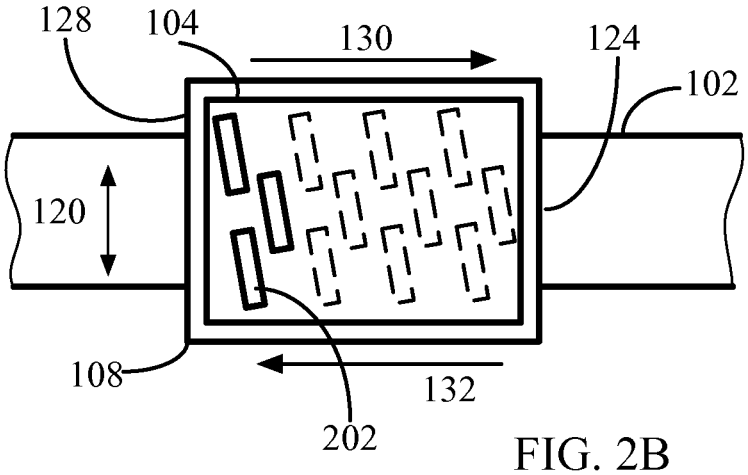

Referring now to FIGS. 2A and 2B, which are plan view simplified illustrations of examples of ink deposition unit 104 individual printhead modules 202 orientation. The orientation of individual print head modules 202 is selected so that to print a widest possible image swath. Such an orientation of print head modules 202 is optimal for printing in a raster mode image occupying all of substrate 112 surface. The native resolution of individual print head modules 202 is usually low in the range of 90 to 128 nozzles per inch. As seen in FIG. 2A print resolution could be increased by proper staggering of the printhead modules or, as shown in FIG. 2B, assembling them at an angle with respect to the ink deposition unit 104 scanning direction (arrows 130 and 132). The individual print head modules 202 orientation and orientation of ink deposition unit 104 is fixed at the production stage. Such ink deposition unit 104 and print head modules 202 orientations match the desire of achieving maximum throughput for printing in the raster mode of images covering the entire substrate 112 surface.

In some examples of printing systems the plurality of printhead modules 202 could be organized in clusters with each cluster printing a designated color. The clusters could be such as for example, Cyan, Magenta, Yellow, and Black (C, M, Y, K) color, or other colors used for printing color images. As indicated above, each ink deposition unit 104 includes edges 124 and 128. In conventional printing, ink deposition unit 104 may be activated to deposit ink while moving in either one of the directions indicated by arrows 130 and 132, so that when printing in a direction indicated by arrow 130, edge 124 is the leading edge and Cyan is the color printed first. Edge 128 is the trailing edge. When printing in the direction indicated by arrow 132, edge 128 becomes the leading edge and edge 124 becomes the trailing edge and Black (K) is the color printed first. Although almost all of inkjet printers operate this way, the changes in the color printing order create a color shift when the same color to be reproduced is printed by reciprocating movement of ink deposition unit 104 in the directions indicated by arrows 130 and 132.

Referring now to FIGS. 3A, 3B, 3C, 3D and 3E, which are examples of layouts of some images that could be printed by employing a regular inkjet printing system such as that of FIG. 1. When employing a printing system having a fixed ink deposition unit 104 orientation and corresponding orientation of individual print head modules 202, the printing time of images covering the full substrate 112 surface such as, for example the area 302 of FIG. 3A marked by a hatched pattern, is the same as the printing time of images covering a selection of various segments of a substrate surface such as ornamental patterns 304, 306, 308 and 310 shown in respective FIGS. 3B, 3C, 3D and 3E. Such patterns could be printed and have use, for example, on automotive glass windshield screens, decorative doors and windows, and similar objects. The printing times could be the same even though an ornamental or partial image covers a substantially smaller surface area of the substrate 112 than an image fully covering the substrate 112 surface area as will be explained in greater detail below.

Reference is now made to FIGS. 4A-4F, which illustrate a method of printing of a frame-like image 430 according to an example. Frame-like image 430 is similar to the image shown in FIG. 3B. Frame like image 430 is located along borders 420 of a substrate 412. The printing could be done employing a printing system similar to printing system 100 of FIG. 1, although printing system 400 could include an ink deposition unit 404 configured to deposit ink on substrate 412 and moving or riding on bridge 402. Ink deposition unit 404 may not be rigidly attached to carriage 408. Ink deposition unit 404 could be rotatively attached to carriage 408 and could have a freedom of rotating 360 degrees clockwise or counter-clockwise. Computer 440 is configured to control printing system 400. Computer 440 could also include an ink deposition unit orienting unit 444 configured to orient ink deposition unit 404 by rotating it clockwise or counter-clockwise on a desired angle and into a desired direction.

Printing system 400 could print ornamental pattern 430 or 304 or a similar pattern by segmental printing, i.e., printing consecutive segments of the final printed image. The ink deposition unit orientating unit 454 could orient ink deposition unit 404 by rotating it clockwise or counter-clockwise to orient ink deposition unit 404 with the longitudinal axis of the image segment to be printed. The rotation angle of the ink deposition unit 404 to print pattern of FIG. 4 could be 360 degrees or less, commonly 270 degrees or less and more commonly less than 180 degrees from its last printing path orientation. Different from these ink deposition unit 404 rotation angles could be employed for printing the pattern of FIG. 3C. Such angle could be for example, an angle of about 120 degrees.

The printing run could begin at a corner 450 of substrate 412. As shown in FIG. 4A, illustrating a point in time in which the printing run has already begun and ink deposition unit 404 is in transition and activated, moving along bridge 402 from corner 450 towards corner 452 printing in a direction indicated by an arrow designated reference numeral 432 or along the long axis of an image segment to be printed and printing a segment 430-1 of image 430 or first axial pass X1. At this stage, edge 124 of the ink deposition unit 104 is the leading edge and edge 128 is the trailing edge. Cyan color is the color printed first. In course of ink deposition unit 404 movement, bridge 402 could remain static.

As shown in FIG. 4B, ink deposition unit 404 has reached corner 452 of substrate 412 having completed printing segment 430-1. Not as in regular raster printing, bridge 402 is not incrementally stepped and carriage 408 does not start the printing in the direction opposite to direction 432. Ink deposition unit 404 at this stage could be rotated in a direction indicated by an arrow designated reference numeral 458. In this example, ink deposition unit 404 is rotated 90 degrees from its last printing orientation, as indicated by broken line ink deposition units 404-1 and 404-2, so that the second axial printing path (Y1) orientation may be now perpendicular to the first axial printing path axis (X1) orientation and ink deposition unit 404 moves along the long axis of an image segment to be printed. The ink deposition unit orientation unit 444 orients or rotates the ink depositing unit about a point 436 being an intersection of the first 432 and second 434 ink deposition unit 404 movement directions. The rotation speed of ink deposition unit 404 may depend on the desired angle of rotation and may be less than 2 seconds, commonly between 1 and 2 seconds and more commonly less than 1 second for a rotation of 90 degrees from the original or previous ink deposition unit 404 orientation of FIG. 4A.

The printing of image segment 430-2 could begin at a corner 452 of substrate 412. As depicted in FIG. 4C, illustrating a point in time in which the axial printing of a segment 430-2 of image 430 has already begun Ink deposition unit 404 upon completion of rotation could remain stationary (static) on bridge 402. Bridge 402 movement in the direction or arrow 434 is activated. This movement displaces ink deposition unit 404 from corner 452 towards corner 454 along the long axis of an image segment to be printed and facilitates printing of a segment 430-2 of image 430. Unlike regular inkjet printing as shown in FIGS. 1 and 2, following the rotation of ink deposition unit 104, edges 124 and 128 maintain their positions: edge 124 remains the leading edge and edge 206 remains the trailing edge. As in the previous section, Cyan color is the color printed first.

As depicted in FIG. 4D, ink deposition unit 404 has reached corner 454 of substrate 412 having completed printing segment 430-2. Ink deposition unit 404 at this stage may be deactivated and rotated about point (axis) 436 in a direction indicated by an arrow designated reference numeral 470. In this example, ink deposition unit 404 may be rotated 90 degrees from its last printing orientation, as indicated by broken line ink deposition units 404-1 and 404-2, so that the second axial printing path (Y) orientation may be now perpendicular to the first axial printing path axis (X1) orientation. At this stage, edge 124 of the ink deposition unit 104 remains the leading edge and edge 128 remains the trailing edge and the same color printing order is maintained and ink deposition unit 404 moves along the long axis of an image segment to be printed.

Reference is now made to FIG. 4E, in which ink deposition unit 404 is at a point in time in which the printing run of axial printing of a segment 430-3 has already begun. Bridge 402 could be stationary while ink deposition unit 404 is activated and moved along stationary bridge 402 from corner 454 towards corner 456 printing in a direction indicated by an arrow designated reference numeral 438 printing segment 430-3 of image 430 at the end of which ink deposition unit 404 could be rotated once again as shown and described in FIGS. 4B and 4D.

As seen in FIG. 4F, following the rotation of ink deposition unit 404, ink deposition unit 404 could remain stationary while bridge 402 could be moved from corner 456 towards corner 450 printing in a direction indicated by an arrow designated reference numeral 442 printing axial segment 430-4 of image 430 and completing image 430. Ink deposition unit 404 moves along the long axis of an image segment to be printed and edge 124 of the ink deposition unit 104 remains the leading edge and edge 128 remains the trailing edge and the same color printing order is maintained When employing a printing system similar to printing system 400 of FIG. 4 equipped with a rotating ink deposition unit 404 (FIGS. 4A-4F), the orientation of ink deposition unit 404 could be varied so that to follow only portions of a travel path of ink deposition unit 404 during which ink deposition unit 404 could be in an activated mode (i.e., printing) such as portions where image is present, eliminating portions such as the portions at which ink deposition unit 404 is deactivated and improving production throughput (reduction of printing time).

As seen in FIG. 5, which is a plan view simplified illustration outlining the travel path taken by ink deposition unit 404 (FIGS. 4A-4F) printing a frame-like image 430 along borders 420 of a substrate 412 employing a printing system similar to printing system 400 of FIG. 4 equipped with a rotating ink deposition unit 404 (FIGS. 4A-4F) the travel path 504 along which ink deposition unit 404 is moved includes only portions of the path during which ink deposition unit 404 is in an activated mode (i.e. printing) and does not include portions in which ink deposition unit 404 is in inactivated mode. In the apparatus employed in FIG. 5, the orientation of ink deposition unit 404 relative to bridge 402 could be varied as desired by rotating ink deposition unit 404. The color printing order is maintained, printing time is reduced and color shift is eliminated.

A simple numerical example shows the difference in throughput of the printer printing according to a regular printing method and to the one disclosed above.

Substrate size 3000×4000 mm

Image size—3000×4000 mm

Printing resolution—720 dots per inch

Native ink deposition unit resolution—90 dpi, although a number of printhead modules have been staggered to increase the ink deposition unit resolution to 180 dpi.

Swath width—150 mm

Printing is in multipass mode and four passes provide the desired printing resolution.

Ink deposition unit movement speed—600 mm/sec

Figure 3A:
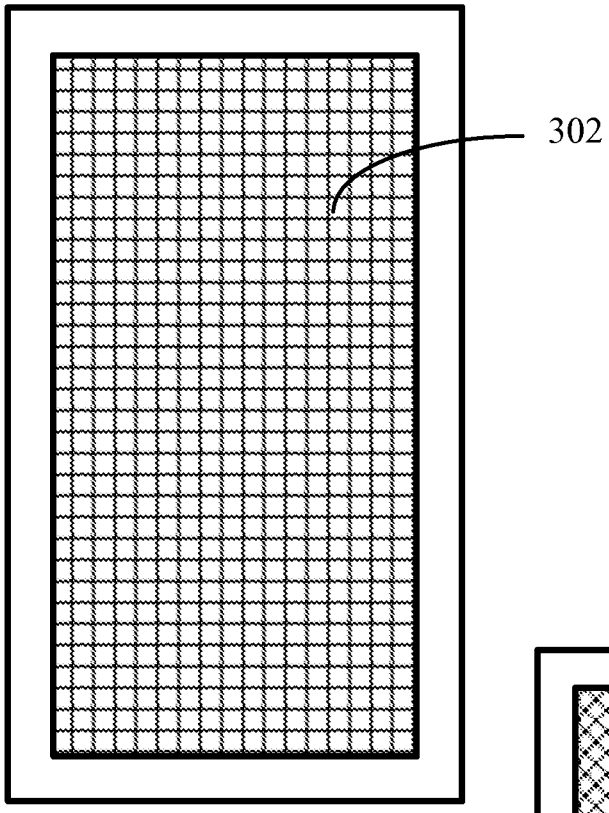
FIGS. 3A, 3B, 3C, 3D and 3E are examples of layouts of some images that could be printed by employing a regular inkjet printing system such as that of FIG. 1.
Figure 3B:
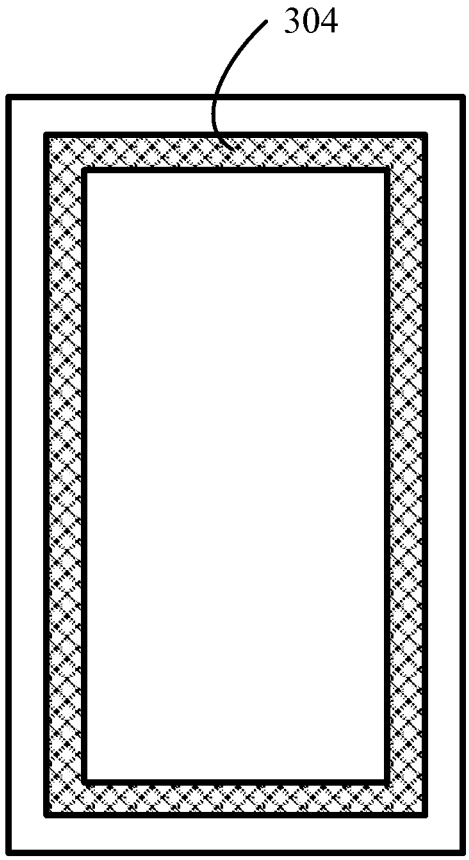
Figure 3C:
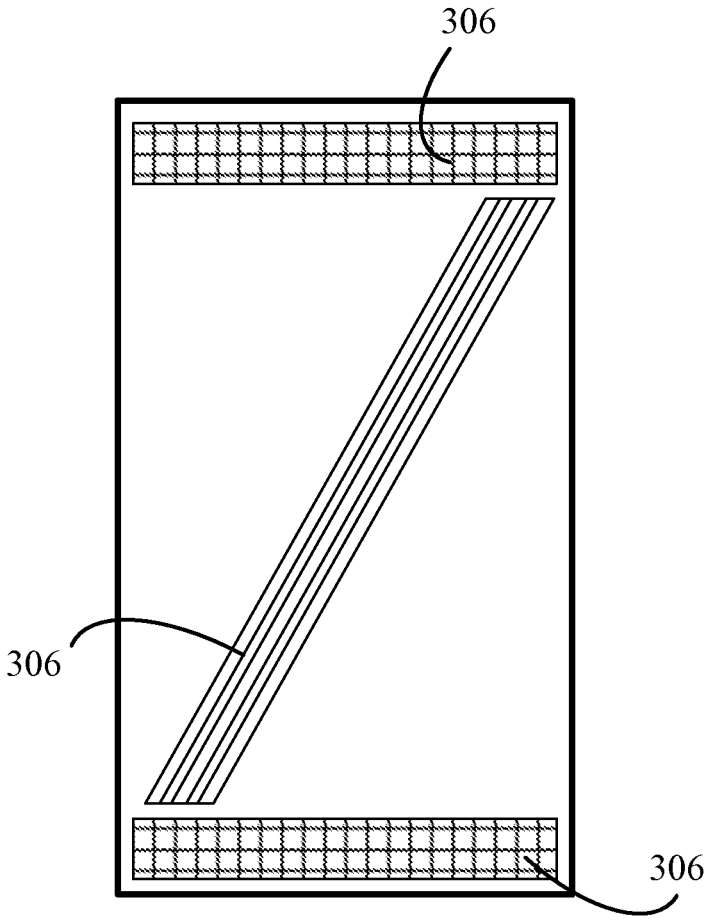
Figure 3D:
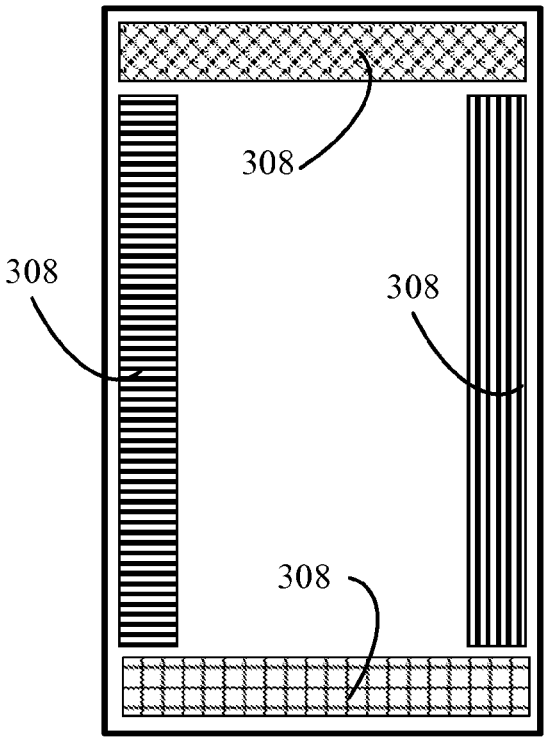
Figure 3E:
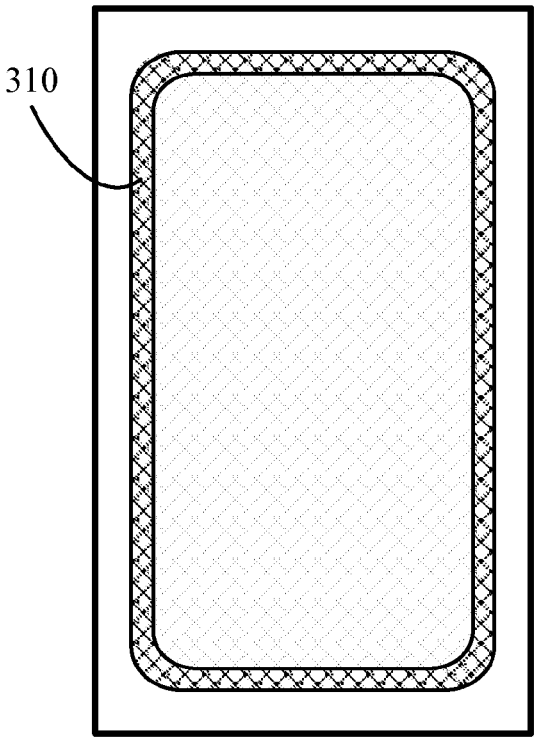

Printing of an image covering the entire surface of the substrate or of an ornamental pattern of FIG. 3B or FIG. 4 in regular printing mode would take 107 passes with each pass duration of 5 second or at least 535 sec (not accounting for the time required to stop and change the travel direction, which could be assumed equal to a second) or a total of 640 sec. The printing according to the method proposed will take 93 second not accounting for the time required for ink deposition unit four rotations/reorientations. The rotation/reorientation speed of ink deposition unit 404 could depend on the desired angle of rotation and could be less than 2 seconds, commonly between 1 and 2 seconds and more commonly less than 1 second for a rotation of 90 degrees from the original ink deposition unit 404 orientation.

The printing time according to the method proposed depicted in FIGS. 4A-4F and FIG. 5 as compared to regular commonly employed raster printing depicted in FIG. 1, could be substantially reduced. The method proposed being about five times faster than the regular raster printing depicted.

The multipass printing mode could be implemented by displacing the ink deposition unit along the bridge or together with the bridge. In any of the movements discussed and despite the change of printing direction the leading edge 124 (FIG. 1) always remains the leading edge. This maintains the order of printing of different colors forming the color image and mitigating undesired image color shifts.

The process described in FIGS. 4A-4F could be repeated as shown in FIG. 5. Frame-like images with width wider than single swath width could be printed in this manner. Additionally, printing of frame-like image 430 along borders 420 of a substrate 412 in multipass printing mode could also be implemented in a similar manner, where the number of passes would depend on the desired printing resolution.

Although faster than regular raster printing the printing method disclosed above when printing prints and ornamental pattern of FIGS. 4A-4F and FIG. 5 the method could result in a longer printing pass travel than the one in a regular raster printing. In a multipass printing it could appear that the time between the first and the second passes (and the second and the third, and the third and the fourth passes) of printing is sufficient to allow ink drops printed at the previous pass to be fully cured/dried. This method of printing would not cause a problem of interaction between the earlier deposited and later deposited drops because the drops printed at one pass do not touch or overlap as shown in FIG. 5. However, in practice, there are errors in drop placement which mean that there may be overlaps, and therefore potential interactions between drops on the surface.

The printed image could include any number of segments having various shapes and shapes at varying angles relative to each other. According to one aspect of the method, the rotation of the ink deposition unit does not change the printing resolution and all image segments could be printed at the same resolution. According to one aspect of the method, different image segments could be printed at different resolution.

It will be appreciated by persons skilled in the art, that the time spent travelling the distance covered by a printing system having a fixed ink deposition unit 104 orientation and corresponding orientation of individual print head modules 202 may be the same regardless of the shape of the printing image or, in other words, whether printing a full substrate 112 surface such as, for example the area 302 of FIG. 3A marked by a hatched pattern or printing a selection of various segments of a substrate surface such as ornamental patterns 304, 306, 308 and 310 shown in respective FIGS. 3B, 3C, 3D and 3E. The only difference is in whether ink deposition unit 104 is activated or inactivated.

FIGS. 6A and 6B which together form a flow diagram summarizing the example method of FIGS. 4A-4F and 5 for operating a printing system to form an image such as image 304 of FIG. 3B or 430 of FIG. 4 at a reduced printing time. Initially a printer including a moveable bridge and a liquid ink deposition unit provided and a substrate to be printed is placed on a substrate support and the printing of the image is carried out employing the following method:

1. The bridge 402 and ink deposition unit 404, which could be controlled by a computer 440 or, are positioned at starting coordinates of the image to be printed (block 600).
2. The ink deposition unit 404 is activated (printing) and moved along a predetermined first axial path of printing (block 602).
3. The ink deposition unit 404 is deactivated upon arrival at the end of the first printing path (block 604).
4. The ink deposition unit 404 is rotated and is oriented with a second axial path of printing (block 606).
5. The ink deposition unit 404 is activated and the moveable bridge 402 is then moved along a predetermined second axial path of printing (block 608).
6. Upon arrival at the end of the second path of printing, the ink deposition unit 404 is deactivated (block 610).
7. The ink deposition unit 404 is then rotated and oriented with a third path of printing (block 612).
8. The ink deposition unit 404 is activated and moved along a predetermined the third axial path of printing (block 614).
9. The ink deposition unit 404 is once again deactivated upon arrival at the end of the third path of printing (block 616).
10. The ink deposition 404 unit is rotated and oriented with a fourth axial path of printing (block 618).
11. The ink deposition unit 404 is activated and the moveable bridge is then moved along a predetermined fourth axial path of printing (block 620).
12. The ink deposition unit 404 is deactivated upon arrival at the end of the fourth path of printing thus completing the raster printing of the image (block 622) and substantially reducing printing time in comparison to regular raster printing.

Mechanical accuracy of the printer and drop position errors could cause a number of artifacts that could be pronounced in the area of ink deposition unit rotation or where the ink deposition unit changed printing direction. A number of methods may be applied to mitigate these potential artifacts. Two or more segments of a printed image may overlap at least a portion of each other (FIGS. 7A-7C and 8A-8C) or, alternatively and optionally, two or more segments of a printed image may complement at least a portion of each other (FIGS. 9A-9C and 10A-10C).

In one example, the area where portions of the first and second segments of the printed image overlap, ink deposition unit 404 (FIGS. 4A-4F) when moving in a first direction could print a portion of the overlapping area and when moving in a second direction the ink deposition unit could print a portion complementing the first segment image overlapping area, such that the printed image appears uniform throughout.

Two or more adjacent image segments may be stitched together by scrambling image pixels such that some are printed by one stroke/swath and interleaved with the other stroke/swath to reduce artifacts.

As seen in FIGS. 7A, 7B and 7C, which are plan view, simplified illustrations of a stitching method of two printed image segments according to an example. The image segments are similar to the image segments depicted in Section A of FIG. 5 a portion 702 of segment 730-2 common with the next to be printed portion 730-3 (FIG. 7B) could be only partially printed in a direction indicated by arrow 712. For example, in FIG. 7A, a portion 702 includes the printing of every other ink drops column 712. In FIG. 7B, segment 730-2 has been removed for illustration purposes only to view a printed segment 730-3 printed in a direction indicated by arrow 770 after the rotation of ink deposition unit 404 (FIG. 4D) in which a portion 404 includes the printing of ink drops columns 712 complementing partially printed portion 702. The result, depicted in FIG. 7C is an image 730, including overlapping portions 702 and 704, which appears uniform throughout.

FIGS. 8A, 8B and 8C are plan view simplified illustrations of a stitching method of two printed image segments according to an example. The image segments are similar to the image segments depicted in Section A of FIG. 5 of a rounded corner similar to that of FIG. 3E in accordance with one example. In FIGS. 8A-8C, a portion 802 of segment 830-2, common with next to be printed portion 830-3 (FIG. 8B) could be only partially printed in a direction indicated by arrow 810. For example, in FIG. 8A, a portion 802 includes the printing of every other ink drops column 810. In FIG. 8B, segment 830-2 has been removed for illustration purposes only to view a printed segment 830-3 printed in a direction indicated by arrow 820 after the rotation of ink deposition unit 404 (FIG. 4D) in which a portion 804 includes the printing of ink drops columns 812 complementing partially printed portion 802. The result, depicted in FIG. 8C is an image 830, including overlapping portions 802 and 804, which appears uniform throughout.

Reference is now made to FIGS. 9A, 9B and 9C, which are plan view simplified illustrations of yet another example of a stitching method of two printed segments similar to the segments depicted in Section A of FIG. 5. The area where the first and the second segments of the printed image abut, ink deposition unit 404 (FIGS. 4A-4F) when moving in a first direction may print a portion of the image and when moving in a second direction the ink deposition unit may print a portion complementing the portion of the first segment, such that the printed image appears uniform throughout.

As shown in FIG. 9A, segment 930-2 of image 930 ends in a diagonal suture line 902 indicated by a diagonal broken line. In FIG. 9B, segment 930-2 has been removed for illustration purposes only to view a printed segment 930-3 beginning at diagonal suture line 902 and printed in a direction indicated by arrow 920 after the rotation of ink deposition unit 904 (FIG. 4D). The result, depicted in FIG. 9C is an image 930, which appears uniform throughout including segments 930-2 and 930-3 abutting at diagonal suture line 902.

Referring now to FIGS. 10A, 10B and 10C, which are plan view simplified illustrations of a stitching method of two printed image segments according to an example. The image segments are similar to the image segments depicted in Section A of FIG. 5.

As shown in FIG. 10A, segment 1030-2 of image 1030 ends in a staircase-like suture line 1002 indicated by a broken line. In FIG. 10B, segment 1030-2 has been removed for illustration purposes only to view a printed segment 1030-3 beginning at staircase-like suture line 1002 and printed in a direction indicated by arrow 1070 after the rotation of ink deposition unit 404 (FIG. 4D). The result, depicted in FIG. 10C is an image 1030, which appears uniform throughout including segments 1030-2 and 1030-3 abutting at staircase-like suture line 1002.

It will be appreciated by persons skilled in the art that the present method and apparatus are not limited to what has been particularly shown and described hereinabove. Rather, the scope of the method and apparatus includes both combinations and sub-combinations of various features described hereinabove as well as modifications and variations thereof which would occur to a person skilled in the art upon reading the foregoing description.

What we claim is:

1. A printing system comprising:

a substrate support;

an ink deposition unit to deposit a liquid ink to a substrate disposed on the substrate support to form images thereon, wherein the ink deposition unit is operative to rotate;

a movement system to provide relative movement between the substrate support and the ink deposition unit; and wherein upon completion of printing an image segment the ink deposition unit is operative to rotate to be oriented with the longitudinal axis of the next image segment to be printed and wherein the rotation does not affect the image resolution.

2. The printing system according to claim 1, wherein the ink deposition unit angle of rotation is less than 360 degrees.

3. The printing system according to claim 1, wherein the ink deposition unit angle of rotation is less than 270 degrees.

4. The printing system according to claim 1, wherein the ink deposition unit angle of rotation is less than 180 degrees.

5. The printing system according to claim 1, wherein the ink deposition unit speed of rotation is less than 2 seconds for a rotation of 90 degrees.

6. The printing system according to claim 1, wherein the ink deposition unit speed of rotation is between 1 and 2 seconds for a rotation of 90 degrees.

7. The printing system according to claim 1, wherein the ink deposition unit speed of rotation is less than 1 seconds for a rotation of 90 degrees.

8. The printing system according to claim 1, wherein rotation of the ink deposition unit also does not affect the color printing order and mitigates color shift.

9. The printing system according to claim 1, wherein the image resolution remains the same throughout the printing session.

10. The printing system according to claim 1, wherein the image resolution remains the same throughout each image segment.

11. A printing system comprising:

a substrate support;

an ink deposition unit to deposit a liquid ink to a substrate disposed on the substrate support to form images thereon, wherein the ink deposition unit is operative to rotate;

a movement system to provide relative movement between the substrate support and the ink deposition unit; and wherein the ink deposition unit is rotatable and operative to print at least two axial images sharing at least one common image portion and having an angle between their longitudinal axes less than 90 degrees.

12. The printing system according to claim 11, wherein the angle between the at least two axial images sharing at least one common image portion is more than 90 degrees.

13. The printing system according to claim 11, wherein the angle between the at least two axial images sharing at least one common image portion is between 90 degrees and 180 degrees.

* * * * *